US010724771B2

(12) United States Patent
Hellmann et al.

(10) Patent No.: US 10,724,771 B2
(45) Date of Patent: Jul. 28, 2020

(54) EJECTOR REFRIGERATION CIRCUIT

(71) Applicant: Carrier Corporation, Farmington, CT (US)

(72) Inventors: Sascha Hellmann, Mainz-Kostheim (DE); Christoph Kren, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 197 days.

(21) Appl. No.: 15/572,020

(22) PCT Filed: May 12, 2015

(86) PCT No.: PCT/EP2015/060453
§ 371 (c)(1),
(2) Date: Nov. 6, 2017

(87) PCT Pub. No.: WO2016/180481
PCT Pub. Date: Nov. 17, 2016

(65) Prior Publication Data

US 2018/0142927 A1 May 24, 2018

(51) Int. Cl.
*F25B 1/10* (2006.01)
*F25B 5/02* (2006.01)
(Continued)

(52) U.S. Cl.
CPC ..... *F25B 41/043* (2013.01); *F25B 1/10* (2013.01); *F25B 5/00* (2013.01); *F25B 5/02* (2013.01);
(Continued)

(58) Field of Classification Search
CPC .. F25B 41/043; F25B 1/10; F25B 5/00; F25B 41/00; F25B 5/02; F25B 2341/0012;
(Continued)

(56) References Cited

U.S. PATENT DOCUMENTS 4,242,885 A 1/1981 Quack
6,857,286 B2 2/2005 Ohta et al.
(Continued)

FOREIGN PATENT DOCUMENTS

CN 101387457 A 3/2009
CN 101952670 A 1/2011
(Continued)

OTHER PUBLICATIONS

International Search Report and Written Opinion for application PCT/EP2015/060453, dated Jan. 20, 2016, 11 pages.
(Continued)

*Primary Examiner* — Frantz F Jules
*Assistant Examiner* — Martha Tadesse
(74) *Attorney, Agent, or Firm* — Cantor Colburn LLP

(57) ABSTRACT

An ejector refrigeration circuit comprises a high pressure ejector circuit comprising in the direction of flow of a circulating refrigerant: a heat rejecting heat exchanger/gas cooler having an inlet side and an outlet side; at least two variable ejectors (6, 7) with different capacities connected in parallel, each of the variable ejectors comprising a primary high pressure input port, a secondary low pressure input port and an output port; wherein the primary high pressure input ports of the at least two variable ejectors are fluidly connected to the outlet side of the heat rejecting heat exchanger/gas cooler; a receiver, having an inlet, a liquid outlet, and a gas outlet, wherein the inlet is fluidly connected to the output ports of the at least two variable ejectors; at least one compressor having an inlet side and an outlet side.

17 Claims, 2 Drawing Sheets

(51) Int. Cl.
*F25B 41/04* (2006.01)
*F25B 41/00* (2006.01)
*F25B 5/00* (2006.01)

(52) U.S. Cl.
CPC ..... *F25B 41/00* (2013.01); *F25B 2341/0012* (2013.01); *F25B 2341/0015* (2013.01); *F25B 2700/195* (2013.01); *F25B 2700/197* (2013.01); *F25B 2700/2109* (2013.01); *F25B 2700/21163* (2013.01); *F25B 2700/21175* (2013.01)

(58) Field of Classification Search
CPC ..... F25B 2700/195; F25B 2700/197; F25B 2700/2109; F25B 2700/21163; F25B 2700/21175; F25B 2341/0015
See application file for complete search history.

(56) References Cited

U.S. PATENT DOCUMENTS

| | | | | |
|---|---|---|---|---|
| 8,776,539 | B2 | 7/2014 | Verma et al. | |
| 9,752,801 | B2 | 9/2017 | Verma et al. | |
| 9,759,462 | B2 | 9/2017 | Zou et al. | |
| 2011/0146313 | A1* | 6/2011 | Finckh | F25B 9/008 62/186 |
| 2011/0259039 | A1 | 10/2011 | Ma et al. | |
| 2012/0116594 | A1* | 5/2012 | Aidoun | F25B 1/06 700/276 |
| 2012/0167601 | A1* | 7/2012 | Cogswell | F25B 1/10 62/115 |
| 2012/0234026 | A1 | 9/2012 | Oh et al. | |
| 2013/0104593 | A1 | 5/2013 | Occhipinti | |
| 2013/0111935 | A1* | 5/2013 | Zou | F25B 9/06 62/117 |
| 2013/0111944 | A1* | 5/2013 | Wang | F25B 43/006 62/500 |
| 2014/0345318 | A1 | 11/2014 | Nagano et al. | |
| 2015/0233624 | A1* | 8/2015 | Hellmann | F25B 7/00 62/117 |
| 2016/0138847 | A1* | 5/2016 | Zimmermann | F25D 3/12 62/384 |

FOREIGN PATENT DOCUMENTS

| | | | | |
|---|---|---|---|---|
| DE | 102008016860 | A1 | 10/2008 | |
| EP | 0142209 | B1 | 3/1988 | |
| EP | 1087185 | B1 | 11/2003 | |
| EP | 1923553 | A2 | 5/2008 | |
| JP | 2008256240 | A * | 10/2008 | F25B 41/00 |
| JP | 2010151424 | A * | 7/2010 | |
| JP | 2010151424 | A | 7/2010 | |
| WO | 2009070728 | A1 | 6/2009 | |
| WO | 2011006251 | A1 | 1/2011 | |
| WO | 2012092685 | A1 | 7/2012 | |
| WO | 2013140990 | A1 | 9/2013 | |

OTHER PUBLICATIONS

Chinese Office Action for application CN 201580079751.X, dated Aug. 5, 2019, 13 pages.

* cited by examiner

EJECTOR REFRIGERATION CIRCUIT

The invention is related to an ejector refrigeration circuit, in particular to an ejector refrigeration circuit comprising at least two ejectors, and a method of controlling the operation of such an ejector refrigeration circuit.

In refrigeration circuits an ejector may be used as an expansion device additionally providing a so called ejector pump for compressing refrigerant from a low pressure level to a medium pressure level using energy that becomes available when expanding the refrigerant from a high pressure level to the medium pressure level.

Accordingly, it would be beneficial to maximise the efficiency of operating an ejector refrigeration circuit, in particular to allow operating the ejector refrigeration circuit with high efficiency over a wide range of operational conditions.

According to an exemplary embodiment of the invention an ejector refrigeration circuit comprises a high pressure circuit comprising in the direction of flow of a circulating refrigerant: a heat rejecting heat exchanger/gas cooler having an inlet side and an outlet side; at least two variable ejectors with different capacities connected in parallel, each of the variable ejectors comprising a primary high pressure input port, a secondary low pressure input port and an output port, wherein the primary high pressure input ports of the at least two variable ejectors are fluidly connected to the outlet side of the heat rejecting heat exchanger/gas cooler; a receiver, having an inlet, a liquid outlet, and a gas outlet, wherein the inlet is fluidly connected to the output ports of the at least two variable ejectors; and at least one compressor having an inlet side and an outlet side, the inlet side of the at least one compressor being fluidly connected to gas outlet of the receiver, and the outlet side of the at least one compressor being fluidly connected to the inlet side of the heat rejecting heat exchanger/gas cooler. The ejector refrigeration circuit further comprises a refrigerating evaporator flowpath comprising in the direction of flow of the circulating refrigerant: at least one refrigeration expansion device having an inlet side, fluidly connected to the liquid outlet of the receiver, and an outlet side; and at least one refrigeration evaporator fluidly connected between the outlet side of the at least one refrigeration expansion device and the secondary low pressure input ports of the at least two variable ejectors.

A method of operating an ejector refrigeration circuit according to an exemplary embodiment of the invention includes selectively operating and/or controlling at least one of the at least two variable ejectors.

The efficiency of an ejector is a function of the high pressure mass flow rate which is given as a control input via the needed high pressure drop. Exemplary embodiments of the invention allow to adjust the mass flow of refrigerant flowing to the ejectors according to the actual ambient temperatures and/or refrigeration demands. This allows to adjust the operation of the ejector refrigeration circuit resulting in an optimized efficiency over a wide range of operational conditions.

SHORT DESCRIPTION OF THE FIGURES

An exemplary embodiment of the invention will be described in the following with respect to the enclosed Figures.

DETAILED DESCRIPTION OF THE FIGURES

Figure 1:
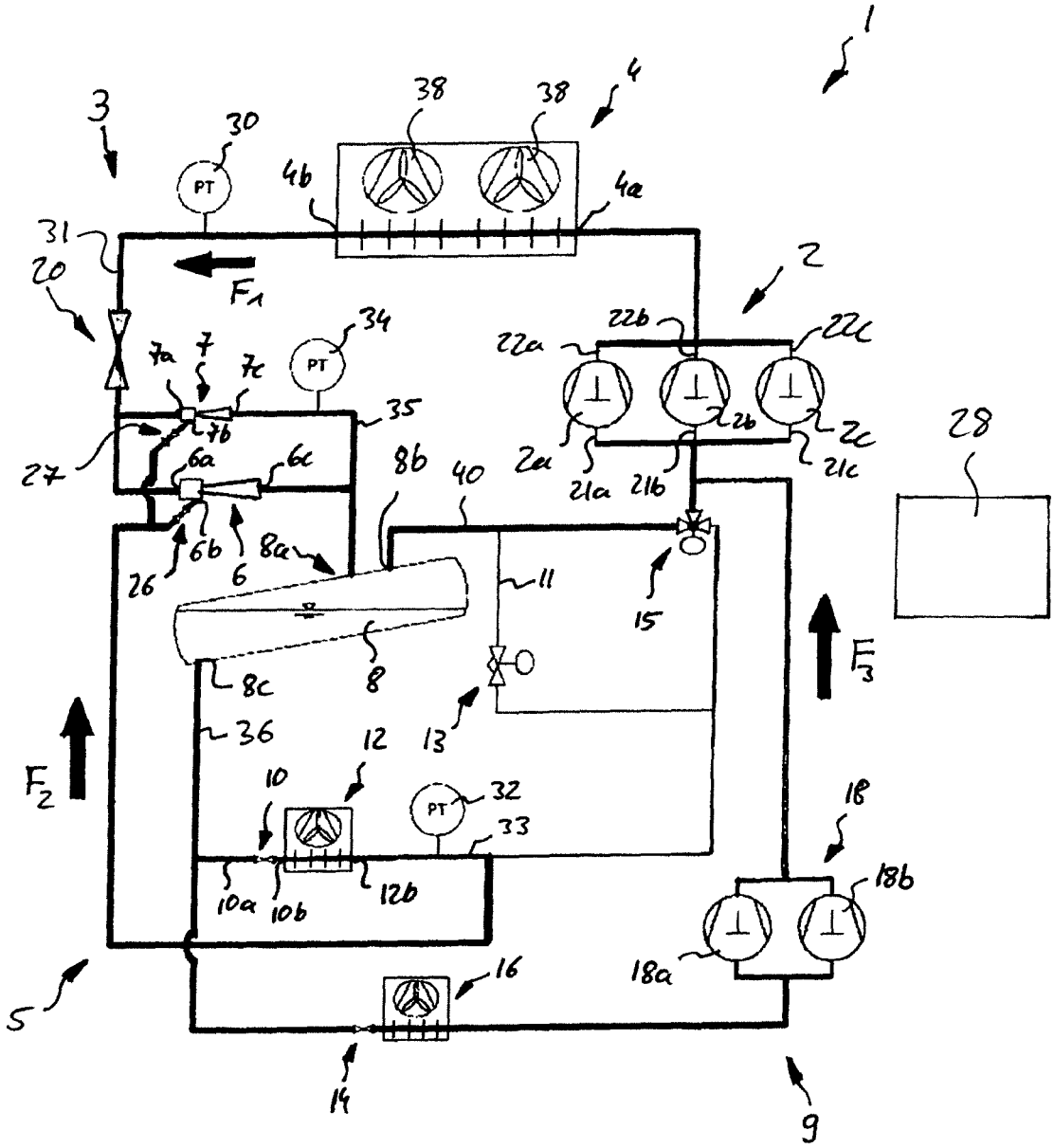
FIG. 1 illustrates a schematic view of an ejector refrigeration circuit according to an exemplary embodiment of the invention.

FIG. 1 illustrates a schematic view of an ejector refrigeration circuit 1 according to an exemplary embodiment of the invention comprising a high pressure ejector circuit 3, a refrigerating evaporator flowpath 5, and a low temperature flowpath 9 respectively circulating a refrigerant as indicated by the arrows $F_1$, $F_2$, and $F_3$.

The high pressure ejector circuit 3 comprises a compressor unit 2 including a plurality of compressors 2*a*, 2*b*, 2*c* connected in parallel.

The high pressure side outlets 22*a*, 22*b*, 22*c* of said compressors 2*a*, 2*b*, 2*c* are fluidly connected to an outlet manifold delivering the refrigerant from the compressors 2*a*, 2*b*, 2*c* via a heat rejection heat exchanger/gas cooler inlet line to the inlet side 4*a* of a heat rejecting heat exchanger/gas cooler 4. The heat rejecting heat exchanger/gas cooler 4 is configured for transferring heat from the refrigerant to the environment reducing the temperature of the refrigerant. In the exemplary embodiment shown in FIG. 1, the heat rejecting heat exchanger/gas cooler 4 comprises two fans 38 which are operable for blowing air through the heat rejecting heat exchanger/gas cooler 4 in order to enhance the transfer of heat from the refrigerant to the environment. Of course, the fans 38 are optional and their number may be adjusted to the actual needs.

The cooled refrigerant leaving the heat rejecting heat exchanger/gas cooler 4 at its outlet side 4*b* is delivered via a high pressure input line 31 and an optional service valve 20 to primary high pressure input ports 6*a*, 7*a* of two variable ejectors 6, 7 with different capacities. The two variable ejectors 6, 7 are connected in parallel to each other and are configured for expanding the refrigerant delivered via the high pressure input line 31 to a reduced (medium) pressure level. Details of the operation of the variable ejectors 6, 7 will be described further below with reference to FIG. 2.

The expanded refrigerant leaves the variable ejectors 6, 7 through respective ejector output ports 6*c*, 7*c* and is delivered by means of an ejector output line 35 to an inlet 8*a* of a receiver 8. Within the receiver 8, the refrigerant is separated by means of gravity into a liquid portion collecting at the bottom of the receiver 8 and a gas phase portion collecting in an upper part of the receiver 8.

The gas phase portion of the refrigerant leaves the receiver 8 through a receiver gas outlet 8*b* provided at the top of the receiver 8. When the ejector refrigeration circuit 1 is operated in the ejector mode, which will be described in more detail below, said gas phase portion is delivered via a receiver gas outlet line 40 and a switchable valve unit 15 to the inlet sides 21*a*, 22*b*, 22*c* of the compressors 2*a*, 2*b*, 2*c* completing the refrigerant cycle of the high pressure ejector circuit 3.

Refrigerant from the liquid phase portion of the refrigerant collecting at the bottom of the receiver 8 exits from the receiver 8 via a liquid outlet 8*c* provided at the bottom of the receiver 8 and is delivered through a receiver liquid outlet line 36 to the inlet side 10*a* of a refrigeration expansion device 10 ("medium temperature expansion device") and, optionally, to a low temperature expansion device 14.

After having left the refrigeration expansion device 10, where it has been expanded, through the outlet side 10*b* of the refrigeration expansion device 10, the refrigerant enters into a refrigeration evaporator 12 ("medium temperature evaporator"), which is configured for operating at "normal" cooling temperatures, in particular in a temperature range of −10° C. to +5° C., for providing "normal temperature" refrigeration.

After having left the refrigeration evaporator 12 via its outlet 12*b*, the evaporated refrigerant flows through a low pressure inlet line 33 and, depending on the setting of the switchable valve unit 15, either into the inlet sides 21*a*, 21*b*, 21*c* of the compressors 2*a*, 2*b*, 2*c* ("baseline mode") or into the inlet sides of two ejector inlet valves 26, 27 ("ejector mode").

The outlet sides of the ejector inlet valves 26, 27, are respectively connected to secondary low pressure input ports 6*b*, 7*b* of the variable ejectors 6, 7. The ejector inlet valves 26, 27 are provided as controllable valves which may be selectively opened and closed based on a control signal provided by a control unit 28. The controllable ejector inlet valves 26, 27 are preferably provided as non-adjustable shut-off valves, i.e. the opening degree of theses valves preferably is not variable. In case the respective ejector inlet valve 26, 27 is open, the refrigerant leaving the refrigeration evaporator 12 is sucked into the respective secondary low pressure input port 6*b*, 7*b* of the associated variable ejector 6, 7 by means of the high pressure flow entering via the respective primary high pressure input port 6*a*, 7*a*. This functionality of the variable ejectors 6, 7 providing an ejector pump will be described in more detail below with reference to FIG. 2.

A flash gas line 11 including a controllable and in particular adjustable flash gas valve 13 and fluidly connecting the gas outlet 8*b* of the receiver 8 to an inlet of the valve unit 15, which is fluidly connected with the outlet 12*b* of the refrigeration evaporator 12, allows to selectively deliver flash gas from the top of the receiver 8 into the inlet sides 21*a*, 21*b*, 21*c* of the compressors 2*a*, 2*b*, 2*c*, when the refrigeration system 1 is operated in baseline mode. Adjusting the controllable and in particular adjustable flash gas valve 13 allows to adjust the gas pressure within the receiver 8 for optimizing the efficiency of the refrigeration system 1.

The portion of the liquid refrigerant that has been delivered to and expanded by the optional low temperature expansion device 14 enters into an optional low temperature evaporator 16, which in particular is configured for operating at low temperatures in the range of −40° C. to −25° C., for providing low temperature refrigeration. The refrigerant that has left the low temperature evaporator 16 is delivered to the inlet side of a low temperature compressor unit 18 comprising one or more, in the embodiment shown in FIG. 1 two, low temperature compressors 18*a*, 18*b*.

In operation, the low temperature compressor unit 18 compresses the refrigerant supplied by the low temperature evaporator 16 to medium pressure, i.e. basically the same pressure as the pressure of the refrigerant which is delivered from the gas outlet 8*b* of the receiver 8. The compressed refrigerant is supplied together with the refrigerant provided from the gas outlet 8*b* of the receiver 8 to the inlet sides 21*a*, 21*b*, 21*c* of the compressors 2*a*, 2*b*, 2*c*.

Sensors 30, 32, 34 which are configured for measuring the pressure and/or the temperature of the refrigerant are respectively provided at the high pressure input line 31 fluidly connected to the primary high pressure input ports 6*a*, 7*a* of the variable ejectors 6, 7, the low pressure input line 33 fluidly connected to the secondary low pressure input ports 6*b*, 7*b* and the output line 35 fluidly connected to the output ports 6*c*, 7*c* of the ejectors 6, 7.

A control unit 28 is configured for controlling the operation of the ejector refrigeration circuit 1, in particular the operation of the compressors 2*a*, 2*b*, 2*b*, 18*a*, 18*b*, the variable ejectors 6, 7 and the controllable valves 26, 27 provided at the secondary low pressure input ports 6*b*, 7*b* of the variable ejectors 6, 7 based on the pressure value(s) and/or the temperature value(s) provided by the sensors 30, 32, 34 and the actual refrigeration demands.

Even when the primary high pressure input port 6*a*, 7*a* of a variable ejector 6, 7 is open, the associated low pressure inlet valve 26, 27 may remain closed for operating the respective variable ejector 6, 7 as a high pressure bypass valve bypassing the other variable ejector 7, 6. The low pressure inlet valve 26, 27 associated with said variable ejector 6, 7 may be opened for increasing the flow of refrigerant flowing through the refrigeration expansion device 10 and the refrigeration evaporator 12 only after the degree of opening of the primary high pressure input port 6*a*, 7*a* has reached a point at which the respective variable ejector 6, 7 runs stable and efficiently.

Although only two variable ejectors 6, 7 are shown in FIG. 1, it is self-evident that the invention may be applied similarly to ejector refrigeration circuits comprising three or more variable ejectors 6, 7 connected in parallel.

The capacity of the second ejector 7 in particular may be twice as large as the capacity of the first ejector 6, the capacity of an optional third ejector (not shown) may be twice as large as the capacity of the second ejector 7 etc. Such a configuration of ejectors 6, 7 provides a wide range of available capacities by selectively operating a suitable combination of variable ejectors 6, 7. Alternatively, the second ejector 7 may have 45% to 80% of the maximum capacity of the first ejector 6.

Each of the plurality of variable ejectors 6, 7 may be selected to operate alone acting as the "first ejector" based on the actual refrigeration demands and/or ambient temperatures in order to enhance the efficiency of the ejector refrigeration circuit 1 by using the variable ejector which may be operated closest to its optimal point of operation.

Figure 2:
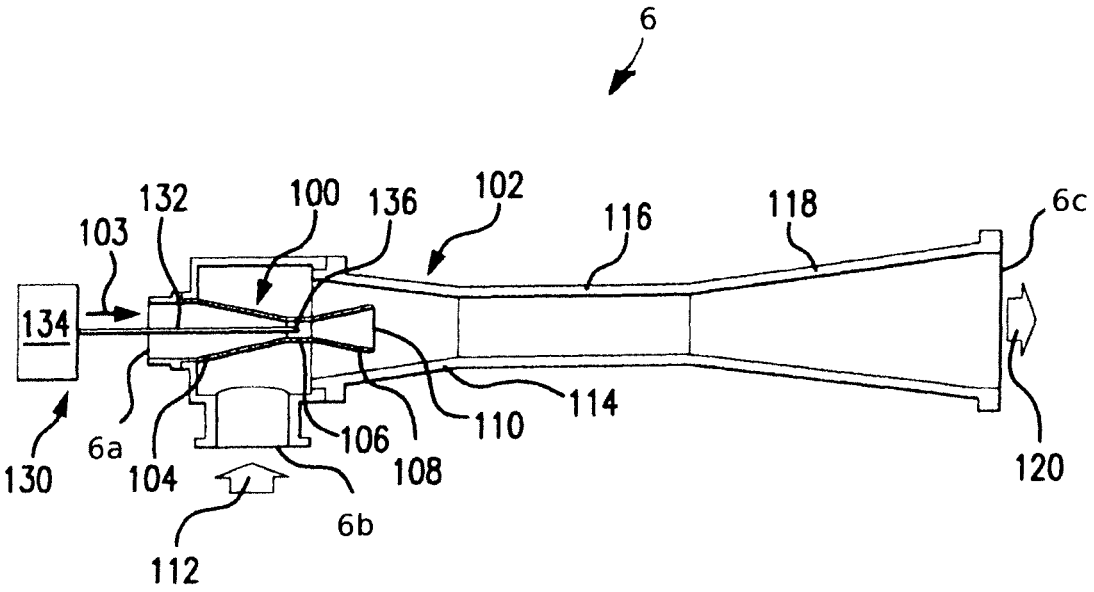
FIG. 2 illustrates a schematic sectional view of a variable ejector as it may be employed in the exemplary embodiment shown in FIG. 1.

FIG. 2 illustrates a schematic sectional view of an exemplary embodiment of a variable ejector 6. A variable ejector 6, as it is shown in FIG. 2, may be employed as each of the variable ejectors 6, 7 in the ejector refrigeration circuit 1 shown in FIG. 1.

The ejector 6 is formed by a motive nozzle 100 nested within an outer member 102. The primary high pressure input port 6*a* forms the inlet to the motive nozzle 100. The output port 6*c* of the ejector 6 is the outlet of the outer member 102. A primary refrigerant flow 103 enters via the primary high pressure input port 6*a* and then passes into a convergent section 104 of the motive nozzle 100. It then passes through a throat section 106 and a divergent expansion section 108 through an outlet 110 of the motive nozzle 100. The motive nozzle 100 accelerates the flow 103 and decreases the pressure of the flow. The secondary low pressure input port 6*b* forms an inlet of the outer member 102. The pressure reduction caused to the primary flow by the motive nozzle draws a secondary flow 112 from the secondary low pressure input port 6*b* into the outer member 102. The outer member 102 includes a mixer having a convergent section 114 and an elongate throat or mixing section 116. The outer member 102 also has a divergent section or diffuser 118 downstream of the elongate throat or mixing section 116. The motive nozzle outlet 110 is positioned within the convergent section 114. As the flow 103 exits the outlet 110, it begins to mix with the secondary flow 112 with further mixing occurring through the mixing section 116 providing a mixing zone. Thus, respective primary and secondary flowpaths respectively extend from the primary high pressure input port 6*a* and the secondary low pressure input port 6*b* to the output port 6*c*, merging at the exit.

In operation, the primary flow 103 may be supercritical upon entering the ejector 6 and subcritical upon exiting the motive nozzle 100. The secondary flow 112 may be gaseous or a mixture of gas with a smaller amount of liquid upon entering the secondary low pressure input port 6*b*. The resulting combined flow 120 is a liquid/vapor mixture and decelerates and recovers pressure in the diffuser 118 while remaining a mixture.

The exemplary variable ejectors 6, 7 employed in exemplary embodiments of the invention are controllable. Their controllability is provided by a needle valve 130 having a needle 132 and an actuator 134. The actuator 134 is configured for shifting a tip portion 136 of the needle 132 into and out of the throat section 106 of the motive nozzle 100 to modulate flow through the motive nozzle 100 and, in turn, the ejector 6 overall. Exemplary actuators 134 are electric, e.g. solenoid or the like. The actuator 134 may be coupled to and controlled by the control unit 28. The control unit 28 may be coupled to the actuator 134 and other controllable system components via hardwired or wireless communication paths. The control unit 28 may include one or more of: processors; memory (e.g., for storing program information for execution by the processor to perform the operational methods and for storing data used or generated by the program(s)); and hardware interface devices (e.g., ports) for interfacing with input/output devices and controllable system components.

FURTHER EMBODIMENTS

A number of optional features are set out in the following. These features may be realized in particular embodiments, alone or in combination with any of the other features.

In an embodiment the maximum capacity, i.e. the maximum mass flow of the second variable ejector, is in the range of 45% to 80% of the maximum capacity of the first variable ejector. This provides an efficient combination of ejectors allowing to adjust their combined capacities over a wide range of operational conditions.

In an alternative embodiment the variable ejectors are provided with doubled capacity ratios, i.e. 1:2:4:8 . . . , in order to cover a wide range of possible capacities.

In an embodiment a switchable low pressure inlet valve is provided upstream of the secondary low pressure input port of each of the variable ejectors. Providing such a switchable low pressure inlet valve allows to operate the respective ejector as a bypass expansion device by closing the switchable low pressure inlet valve of the respective ejector.

In an embodiment at least one sensor, which is configured for measuring the pressure and/or the temperature of the refrigerant, is provided in at least one of a high pressure input line fluidly connected to the primary high pressure input ports, a low pressure input line fluidly connected to the secondary low pressure input ports and an output line fluidly connected to the output ports of the variable ejectors, respectively. Such sensors allow to optimize the operation of the variable ejectors based on the measured pressures and/or temperatures.

In an embodiment at least one service valve is provided upstream of the variable ejectors' primary high pressure input ports allowing to shut down the flow of refrigerant to the primary high pressure input ports in case an ejector needs to be maintained or replaced.

In an embodiment the ejector refrigeration circuit further comprises at least one low temperature circuit, which is connected between the liquid outlet of the receiver and the inlet side of the at least one compressor. The low temperature circuit comprises in the direction of flow of the refrigerant: at least one low temperature expansion device; at least one low temperature evaporator; and at least one low temperature compressor for providing low temperatures in addition to medium cooling temperatures provided by the refrigerating evaporator flowpath.

In an embodiment the ejector refrigeration circuit further comprises a switchable valve unit which is configured for fluidly connecting the inlet side of the at least one compressor selectively either to the gas outlet of the receiver for ejector operation or to the outlet of the refrigeration evaporator for baseline operation of the ejector refrigeration circuit. Baseline operation is more efficient when the pressure difference between the primary high pressure input port and the output port of the ejector is low, while ejector operation is more efficient when the pressure difference between the primary high pressure input port and the output port of the ejector is high.

In an embodiment the ejector refrigeration circuit further comprises a flash gas line fluidly connecting the gas outlet of the receiver to an inlet of the valve unit which is fluidly connected with the outlet of the refrigeration evaporator. The flash gas line preferably comprises a controllable and in particular adjustable flash gas valve. Selectively delivering flash gas from the top of the receiver to the inlet side of the compressors may help to increase the efficiency of operating the ejector refrigeration circuit.

Operating an ejector refrigeration circuit according to an embodiment of the invention may include operating only a first ejector, which has a smaller capacity than a second ejector, until its maximum capacity, i.e. its maximum mass flow, of the first ejector is reached; and, in case the actual refrigeration demand exceeds the maximum capacity of the first ejector, switching-off the first ejector and operating the second ejector until its maximum capacity, i.e. its maximum mass flow, is reached; and, in case the actual refrigeration demand exceeds even the maximum capacity of the second ejector, operating the first ejector in addition to the second ejector. This allows to operate the ejector refrigeration circuit with its maximum efficiency over a wide range of refrigeration demands.

In an embodiment the method includes gradually opening the primary high pressure input port of at least one additional variable ejector in order to adjust the mass flow through the additional variable ejector to the actual refrigeration demands. Gradually opening the primary high pressure input port allows for an exact adjustment of the mass flow through the additional variable ejector.

In an embodiment the method further includes operating at least one of the variable ejectors with its secondary low pressure input port being closed. A controllable valve may be provided at the secondary low pressure input port of at least one/each of the variable ejectors allowing to close the respective secondary low pressure input port. The controllable valve provided at the secondary low pressure preferably is provided as controllable, but non-adjustable shut-off valve; i.e. as a valve which may be selectively opened and closed based on a control signal provided by the control unit. The opening degree of said controllable valve, however, preferably is not variable. This allows to run at least one of the variable ejectors as a bypass high pressure control valve increasing the mass flow of the refrigerant through the heat rejecting heat exchanger/gas cooler in case said ejector would not run stable and/or efficiently when its secondary low pressure input port is open.

In an embodiment the method further includes opening the secondary low pressure input port of the at least one ejector, which has been operated with its secondary low pressure input port being closed, for increasing the mass flow of refrigerant flowing through the heat rejecting heat exchanger(s) in order to meet the actual refrigeration demands.

In an embodiment the method further includes the step of closing the needle valve provided in the primary high pressure input port and/or the ejector inlet valve provided at the secondary low pressure input port of the first ejector in case the ejector refrigeration circuit is operated more efficiently by running only at least one of the additional variable ejectors.

In an embodiment the method further includes using carbon dioxide as refrigerant, which provides an efficient and safe refrigerant.

In case temperature and/or pressure sensors are provided in at least one of a high pressure inlet line fluidly connected to the primary high pressure input ports, a low pressure inlet line fluidly connected to the secondary low pressure input ports and an ejector outlet line fluidly connected to the output ports of the at least two ejectors, respectively, the method may include controlling the at least one compressor, the at least two ejectors and/or the switchable low pressure inlet valves based on the output value(s) of at least one of the pressure and/or the temperature sensors in order to optimize the efficiency of the ejector refrigeration circuit.

In an exemplary embodiment the method comprises operating at least one low temperature circuit for providing low temperatures at a low temperature evaporator.

In case the ejector refrigeration circuit comprises a switchable valve unit, which is configured for selectively connecting the inlet side of the at least one compressor either to the gas outlet of the receiver or to the outlet of the refrigeration evaporator, the method may include switching the switchable valve for selectively connecting the inlet side of the at least one compressor either to the gas outlet of the receiver for operating the ejector refrigeration circuit in an ejector mode, or to the outlet of the refrigeration evaporator for operating the ejector refrigeration circuit in a baseline mode. The ejector mode is more efficient in case of a high pressure difference between the primary high pressure input port and the output port of the ejector, while the baseline mode is more efficient in case of a low pressure difference between the primary high pressure input port and the output port of the ejector.

The method may further include operating a controllable and in particular adjustable flash gas valve, which is provided in a flash gas line fluidly connecting to the gas outlet of the receiver to the outlet of the refrigeration evaporator for adjusting the gas pressure within the receiver.

While the invention has been described with reference to exemplary embodiments, it will be understood by those skilled in the art that various changes may be made and equivalence may be substitute for elements thereof without departing from the scope of the invention. In particular, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pending claims.

REFERENCE NUMERALS

1 refrigeration system
2 compressor unit
2*a*, 2*b*, 2*c* compressors
3 high pressure ejector circuit
4 heat rejecting heat exchanger/gas cooler
4*a* inlet side of the heat rejecting heat exchanger/gas cooler
4*b* outlet side of the heat rejecting heat exchanger/gas cooler
5 refrigerating evaporator flowpath
6 first variable ejector
6*a* primary high pressure inlet port of the first variable ejector
6*b* secondary low pressure inlet port of the first variable ejector
6*c* output port of the first variable ejector
7 second variable ejector
7*a* primary high pressure inlet port of the second variable ejector
7*b* secondary low pressure inlet port of the second variable ejector
7*c* output port of the second variable ejector
8 receiver
8*a* inlet of the receiver
8*b* gas outlet of the receiver
8*c* liquid outlet of the receiver
9 low temperature flowpath
10 refrigeration expansion device
10*a* inlet of the refrigeration expansion device
10*b* outlet of the refrigeration expansion device
11 flash gas line
12 refrigeration evaporator
12*b* outlet side of the refrigeration evaporator
13 flash gas valve
14 low temperature expansion device
15 switchable valve unit
16 low temperature evaporator
18 low temperature compressor unit
18*a*, 18*b* low temperature compressors
20 service valve
21*a*, 21*b*, 21*c* inlet side of the compressors
22*a*, 22*b*, 22*c* outlet side of the compressors
28 control unit
30, 32, 34 pressure sensors
31 high pressure inlet line
33 low pressure inlet line
35 ejector outlet line
38 fan of the heat rejecting heat exchanger/gas cooler

The invention claimed is:

1. An ejector refrigeration circuit with:

a high pressure ejector circuit comprising in a direction of flow of a circulating refrigerant:

a heat rejecting heat exchanger having an inlet side and an outlet side;

at least two variable ejectors with different capacities connected in parallel, each of the at least two variable ejectors comprising a controllable motive nozzle, a primary high pressure input port, a secondary low pressure input port and an output port; wherein the primary high pressure input ports of the at least two variable ejectors are fluidly connected to the outlet side of the heat rejecting heat exchanger;

a receiver, having an inlet, a liquid outlet, and a gas outlet, wherein the inlet is fluidly connected to the output ports of the at least two variable ejectors;

at least one compressor having an inlet side and an outlet side, the inlet side of the at least one compressor being fluidly connected to the gas outlet of the receiver, and the outlet side of the at least one compressor being fluidly connected to the inlet side of the heat rejecting heat exchanger; and a refrigerating evaporator flowpath comprising in the direction of flow of the circulating refrigerant:

at least one expansion device valve having an inlet side, fluidly connected to the liquid outlet of the receiver, and an outlet side;

at least one refrigeration evaporator fluidly connected between the outlet side of the at least one expansion device valve and the secondary low pressure input ports of the at least two variable ejectors.

2. The ejector refrigeration circuit of claim 1, wherein a maximum capacity of a second variable ejector of the at least two variable ejectors is in a range of 45% to 80% of a maximum capacity of a first variable ejector of the at least two variable ejectors.

3. The ejector refrigeration circuit of claim 1, wherein each of the at least two variable ejectors comprises a switchable low pressure inlet valve at the secondary low pressure input port.

4. The ejector refrigeration circuit of claim 1, wherein a pressure and/or temperature sensor is provided in at least one of a high pressure inlet line fluidly connected to the primary high pressure input ports, a low pressure inlet line fluidly connected to the secondary low pressure input ports and an ejector outlet line fluidly connected to the output port of the at least two variable ejectors, respectively.

5. The ejector refrigeration circuit of claim 3, further comprising a control unit, which is configured for controlling the at least one compressor, the at least two variable ejectors and/or the switchable low pressure inlet valves based on the pressures and/or temperatures measured by the pressure and/or temperature sensor.

6. The ejector refrigeration circuit of claim 1, further comprising at least one low temperature circuit which is connected between the liquid outlet of the receiver and the inlet side of the at least one compressor and comprises in the direction of flow of the circulating refrigerant:

at least one expansion valve;

at least one low temperature evaporator; and at least one low temperature compressor.

7. The ejector refrigeration circuit of claim 1, further comprising a switchable valve which is configured for fluidly connecting the inlet side of the at least one compressor selectively either to a gas outlet of the receiver or to an outlet of the at least one refrigeration evaporator.

8. The ejector refrigeration circuit of claim 7 further comprising a flash gas line, fluidly connecting the gas outlet of the receiver to an inlet of the switchable valve unit which is fluidly connected with the outlet of the at least one refrigeration evaporator.

9. A method of operating an ejector refrigeration circuit with:

a high pressure ejector circuit comprising in the direction of flow of a circulating refrigerant:

a heat rejecting heat exchanger having an inlet side and an outlet side;

at least two variable ejectors with different capacities and connected in parallel, each of the at least two variable ejectors comprising a controllable motive nozzle, a primary high pressure input port, a secondary low pressure input port, and an output port; wherein the primary high pressure input ports of the at least two variable ejectors are fluidly connected to the outlet side of the heat rejecting heat exchanger;

a receiver, having an inlet, a liquid outlet, and a gas outlet, wherein the inlet is fluidly connected to the output ports of the at least two variable ejectors;

at least one compressor having an inlet side and an outlet side, the inlet side of the at least one compressor being fluidly connected to gas outlet of the receiver, and the outlet side of the at least one compressor being fluidly connected to the inlet side of the heat rejecting heat exchanger; and a refrigerating evaporator flowpath comprising in the direction of flow of the circulating refrigerant:

at least one expansion valve having an inlet side fluidly connected to the liquid outlet of the receiver, and an outlet side;

at least one refrigeration evaporator fluidly connected between the outlet side of the at least one expansion valve and the secondary low pressure input ports of the at least two variable ejectors;

wherein the method includes selectively operating and/or controlling the motive nozzle of at least one of the at least two variable ejectors.

10. The method of claim 9, wherein the method includes:

operating only the first ejector having a smaller capacity than the second ejector until its maximum capacity is reached;

in case the actual refrigeration demand exceeds the maximum capacity of the first ejector: switching-off the first ejector and operating the second ejector until its maximum capacity is reached; and in case the actual refrigeration demand exceeds the maximum capacity of the second ejector: operating the first ejector in addition to the second ejector.

11. The method of claim 10, wherein each of the at least two variable ejectors (6, 7) comprises a switchable low pressure inlet valve at its secondary low pressure input port and the method includes controlling said switchable low pressure inlet valves.

12. The method of claim 11, wherein a temperature and/or pressure sensor is provided in at least one of a high pressure inlet line fluidly connected to the primary high pressure input ports, a low pressure inlet line fluidly connected to the secondary low pressure input ports and an ejector outlet line fluidly connected to the output ports of the at least two ejectors, respectively, and the method includes controlling the at least one compressor (2*a*, 2*b*, 2*c*), the at least two ejectors and/or the switchable low pressure inlet valves based on the output value(s) of at least one of the pressure and/or the temperature sensors.

13. The method of claim 9, wherein the ejector refrigeration circuit further comprises at least one low temperature circuit which is connected between the liquid outlet of the receiver and the inlet side of the at least one compressor and comprises in the direction of flow of the refrigerant:

at least one low temperature expansion device;

at least one low temperature evaporator; and at least one low temperature compressor;

and wherein the method comprises operating the at least one low temperature circuit for providing low temperatures at the low temperature evaporator.

14. The method of claim 9, wherein the ejector refrigeration circuit further comprises a switchable valve unit configured for selectively connecting the inlet side of the at least one compressor either to the gas outlet of the receiver or to the outlet of the refrigeration evaporator and the method comprises selectively connecting the inlet side of the at least one compressor either to the gas outlet of the receiver or to the outlet of the refrigeration evaporator by switching the switchable valve unit.

15. The method of claim 9, wherein the ejector refrigeration circuit further comprises a flash gas line including a controllable and in particular adjustable flash gas valve, the flash gas line fluidly connecting the gas outlet of the receiver to the outlet of the refrigeration evaporator, wherein the method includes controlling the flash gas valve for adjusting the gas pressure within the receiver.

16. The ejector refrigeration circuit of claim 8, wherein the flash gas line preferably comprises a controllable, adjustable flash gas valve.

17. An ejector refrigeration circuit with:

a high pressure ejector circuit comprising in a direction of flow of a circulating refrigerant:

a heat rejecting heat exchanger having an inlet side and an outlet side;

at least two variable ejectors with different capacities connected in parallel, each of the at least two variable ejectors comprising a controllable motive nozzle, a primary high pressure input port, a secondary low pressure input port and an output port; wherein the primary high pressure input ports of the at least two variable ejectors are fluidly connected to the outlet side of the heat rejecting heat exchanger;

a receiver, having an inlet, a liquid outlet, and a gas outlet, wherein the inlet is fluidly connected to the output ports of the at least two variable ejectors;

at least one compressor having an inlet side and an outlet side, the inlet side of the at least one compressor being fluidly connected to the gas outlet of the receiver, and the outlet side of the at least one compressor being fluidly connected to the inlet side of the heat rejecting heat exchanger;

a refrigerating evaporator flowpath comprising in the direction of flow of the circulating refrigerant:

a first expansion valve having an inlet side, fluidly connected to the liquid outlet of the receiver, and an outlet side;

a first refrigeration evaporator fluidly connected between the outlet side of the at least one expansion valve and the secondary low pressure input ports of the at least two variable ejectors; and at least one low temperature circuit which is connected between the liquid outlet of the receiver and the inlet side of the at least one compressor and comprises in the direction of flow of the circulating refrigerant:

a second expansion valve different than the first expansion valve;

at least one low temperature evaporator different than the first refrigeration evaporator; and at least one low temperature compressor different than the at least one compressor.

* * * * *